US008528841B2

(12) United States Patent
Cheng

(10) Patent No.: US 8,528,841 B2
(45) Date of Patent: Sep. 10, 2013

(54) SPRAY SWITCH FOR SPRAY GUN

(76) Inventor: Chi-Han Cheng, Taichung (TW)

( * ) Notice: Subject to any disclaimer, the term of this patent is extended or adjusted under 35 U.S.C. 154(b) by 603 days.

(21) Appl. No.: 12/662,390

(22) Filed: Apr. 14, 2010

(65) Prior Publication Data

US 2011/0226875 A1 Sep. 22, 2011

(30) Foreign Application Priority Data

Mar. 17, 2010 (TW) ..... 99107898 A

(51) Int. Cl.
*B05B 9/01* (2006.01)

(52) U.S. Cl.
USPC ..... 239/526; 239/394; 239/525; 239/569; 239/583; 251/101; 251/105; 251/285

(58) Field of Classification Search
USPC ..... 239/525, 526, 569, 583, 586, 394; 251/101, 103–105, 107–109, 285, 904
See application file for complete search history.

(56) References Cited

U.S. PATENT DOCUMENTS

| | | | | |
|---|---|---|---|---|
| 2,208,850 | A * | 7/1940 | Mayer | 251/109 |
| 6,454,187 | B1 * | 9/2002 | Wang | 239/526 |
| 7,080,795 | B2 * | 7/2006 | Chen | 239/526 |
| 7,434,750 | B2 * | 10/2008 | Roman | 239/583 |

* cited by examiner

*Primary Examiner* — Steven J Ganey
(74) *Attorney, Agent, or Firm* — Raymond Y. Chan; David and Raymond Patent Firm

(57) ABSTRACT

A spray switch for spray gun includes an elastic wire buckled to a main pipe of the spray gun. The elastic wire has symmetric lateral portions and symmetric guide pins on two ends thereof. A press handle pivoted to a main body of the spray gun is capable of controlling a flow of water. The press handle has an open slot for slidly arranging the spray switch. The spray switch is assembled by a guide block and a buckle unit. The guide block has symmetric guides and recesses on two lateral sides for guiding and holding the guide pins. The spray switch can be switched up and down along the open slot to switch the guide block for engaging or ignoring the guide pins so as to switch the spray gun between modes of auto spray and manual spray.

5 Claims, 13 Drawing Sheets

SPRAY SWITCH FOR SPRAY GUN

FIELD OF THE INVENTION

The present invention relates to spray switch for spray gun, and particular to a spray switch arranged to a press handle for controlling the water spray.

DESCRIPTION OF THE PRIOR ART

Referring to FIGS. 1 and 2, prior public patent about a spray gun having a press handle pivoted to a handle of the spray gun for controlling water flow is descript in the following.

A spray gun main body 10 consists of a nozzle 12 transversely connected to a vertical main pipe 11. A vertical shaft 13 is formed to a peripheral of the main pipe 11 below the nozzle 12. A platform 14 is formed to a bottom of the nozzle 12 in front of the vertical shaft 13. A side pipe 111 extends from a middle of the main pipe 11. A sliding shaft 15 is sealed slid into the side pipe 111. A valve shaft 16 is arranged inside the main pipe 11 below the side pipe 111. Around a peripheral of a bottom end of the main pipe 10, symmetric lateral slots 112 and rear slots 113 are formed. The main pipe 11 is surrounded by a handle 17. The handle 17 is open on the side of the side pipe 111. A compress spring 20 is slid around the side pipe 111, one end of the compress spring 20 is pushed against a junction of the main pipe 11 and the side pipe 111 and another end thereof is pushed against a flange 151 formed to an end of the side pipe 111.

An approximate square elastic wire 30 is buckled into the rear slots 113 with a middle section of the elastic wire 30. Two parallel sections extending from the middle section of the elastic wire 30 are buckled into the lateral slots 112. The two end of the elastic wire 30 are bent towards each other so as to form as two symmetric guide pins 32.

A hollow press handle 40 has a receiving chamber 41 inside the handle 40. Two symmetric holes 42 are formed to an upper end of the press handle 40 so that the press handle 42 is pivoted to the vertical shaft 13 of the main body 10. An open side of the press handle 40 is faced to the handle 17, and a part of the open side of the press handle 40 can be inserted into the open side of the handle 17. A slot 43 is formed to a bottom of the receiving chamber 41, a guide block 44 is fixed to the slot 43. A predetermined space is formed between the two lateral sides of the guide block 44 and the opposite inner wall of the receiving chamber 41. Two symmetric guide slots 441 and recesses 442 are formed to the two lateral sides of the guide block 44 respectively.

Normally, the flange 151 is push against an inner wall of the press handle 40. By the compress spring 20 pushing, the sliding shaft 15 pushes the press handle 40 so that a top of the press handle 40 is contacted to the platform 14 of the nozzle 12.

While water comes into the main pipe 11, the valve shaft 16 inside the main pipe 11 will be pushed upwards by the water flow to seal an inlet of the main pipe 11. In the mean time, an upper end of the valve shaft 16 contacts to an end of the sliding shaft 15 inside the side pipe 111.

While the press handle 40 is pushed towards the handle 17, the guide block 44 will be moved towards the guide pin 32. The guide pins 32 will be bent upwards and slid along an upper rim of the recesses 442 and an upper rim of the guides 441 while the press handle 40 is firstly pressed, the guide pins 32 will be held into the recesses 442 while the press handle 40 is released so that the spray gun is able to continuous spray water as the press handle 40 is held. Also, the sliding shaft 15 is slid into the side pipe 111 and the valve shaft 16 is thus pushed so that water will flow into the main pipe 11.

After the second press and release of the press handle 40, the guide pins 32 will leave the recesses 442 and the press handle 40 is back to the origin position by the force of the compress spring 20.

Two Japan patents of no. JP-A-2005-138056 and JP-A-2009-22848 also have the same function with the above technique. The spray nozzle can continuously spray by a single pressing.

However, such spray nozzle does not have other operating mode. The water flow can not be controlled by the handle.

SUMMARY OF THE PRESENT INVENTION

Accordingly, the primary object of the present invention is to provide a spray switch for spray gun capable of switch between operation modes of auto spray and manual spray with water flow control.

To achieve above object, the spray switch includes an elastic wire buckled to a main pipe of the spray gun. The elastic wire has symmetric lateral portions and symmetric guide pins on two ends thereof. A press handle pivoted to a main body of the spray gun is capable of control a flow of water. The press handle has an open slot for slidly arranging the spray switch. The spray switch is assembled by a guide block and a buckle unit. The guide block has symmetric guides and recesses on two lateral sides for guiding and holding the guide pins. The spray switch can be switched up and down along the open slot to switch the guide block for engaging or ignoring the guide pins so as to switch the spray gun between modes of auto spray and manual spray.

DETAILED DESCRIPTION OF THE INVENTION

Figure 1:
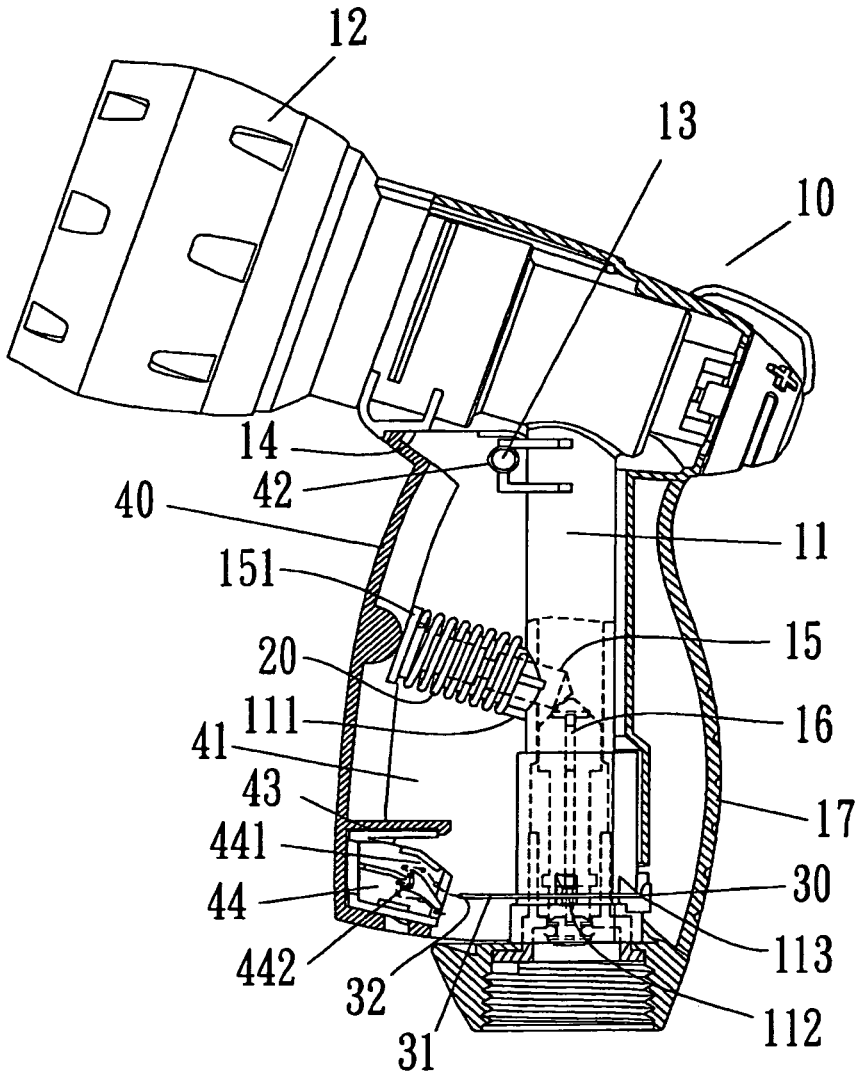
FIG 1 PRIOR ART
FIG. 1 is a perspective view showing a spray switch of a prior art.
Figure 2:
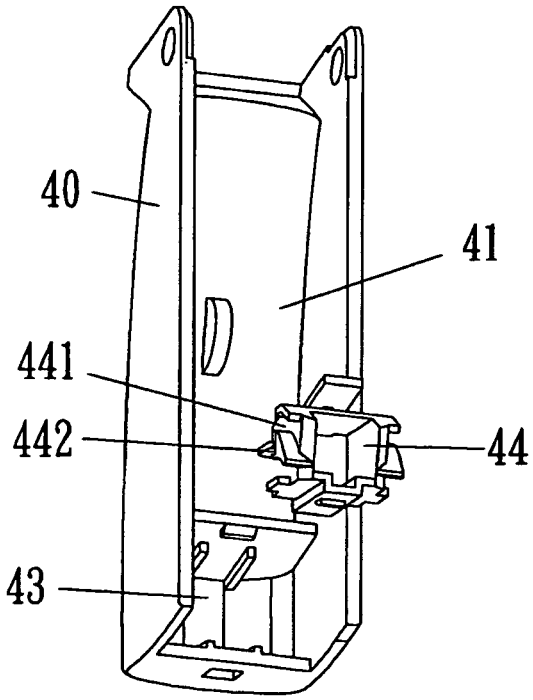
FIG 2 PRIOR ART
FIG. 2 is an exploded view showing a spray switch and a press handle of a prior art.
Figure 3:
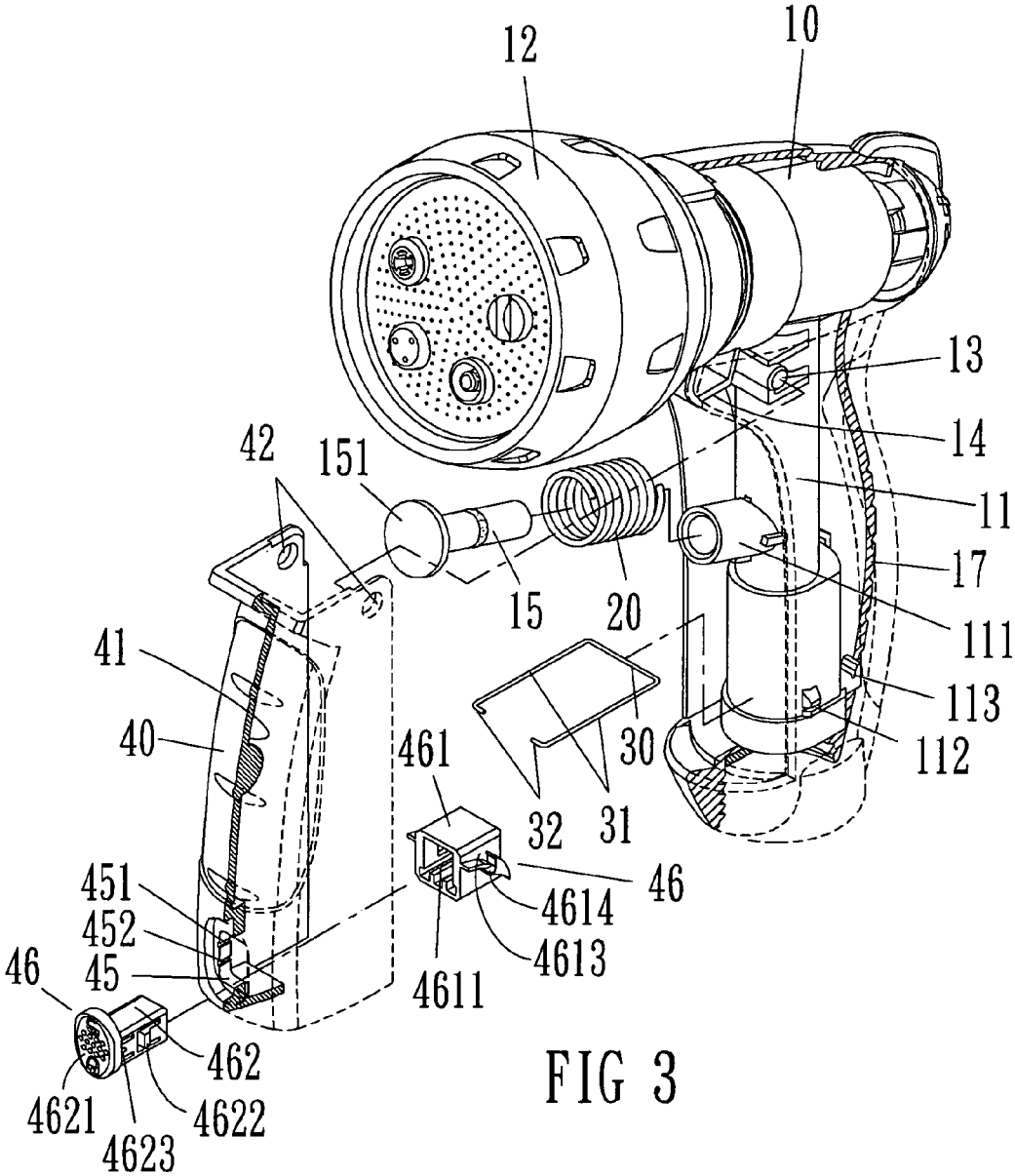
FIG. 3 is an exploded view showing a preferable embodiment of the present invention.
Figure 4:
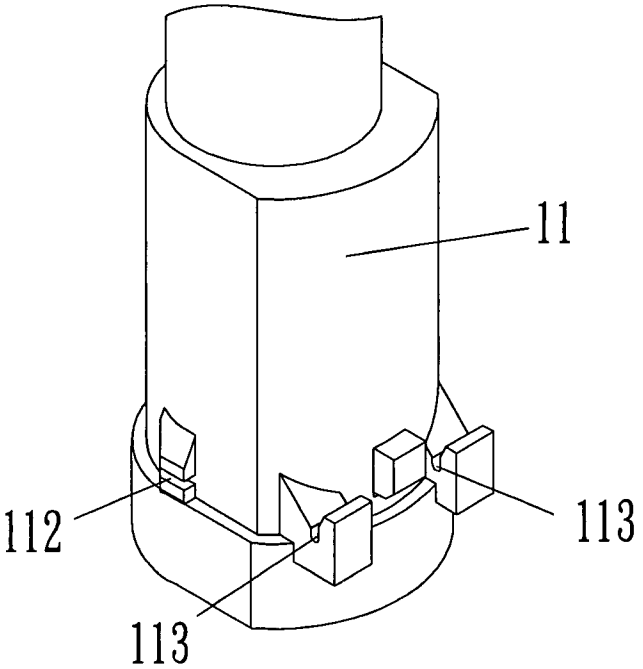
FIG. 4 is a schematic view showing a bottom of a main pipe of the preferable embodiment of the present invention.
Figure 6:
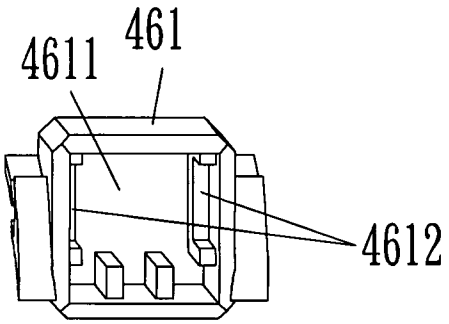
FIG. 6 is a rear view showing a guide block of the spray switch of the present invention.
Figure 5:
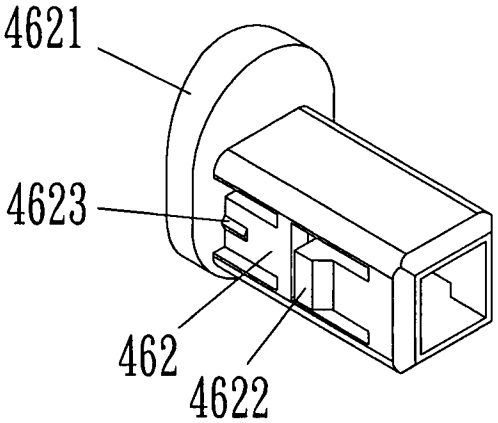
FIG. 5 is a rear view showing a buckle unit of the spray switch of the present invention.
Figure 7:
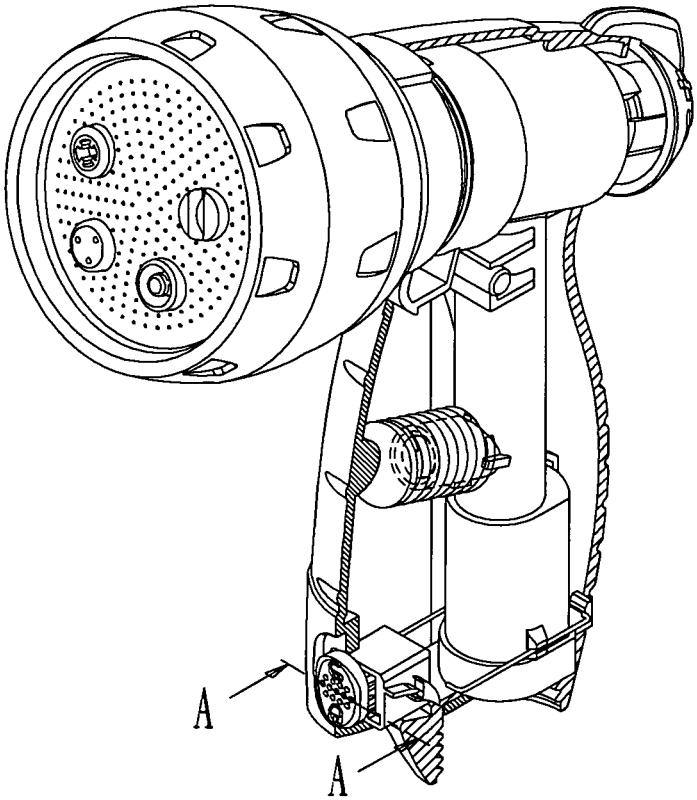
FIG. 7 is an assembly view of the preferable embodiment of the present invention.
Figure 8:
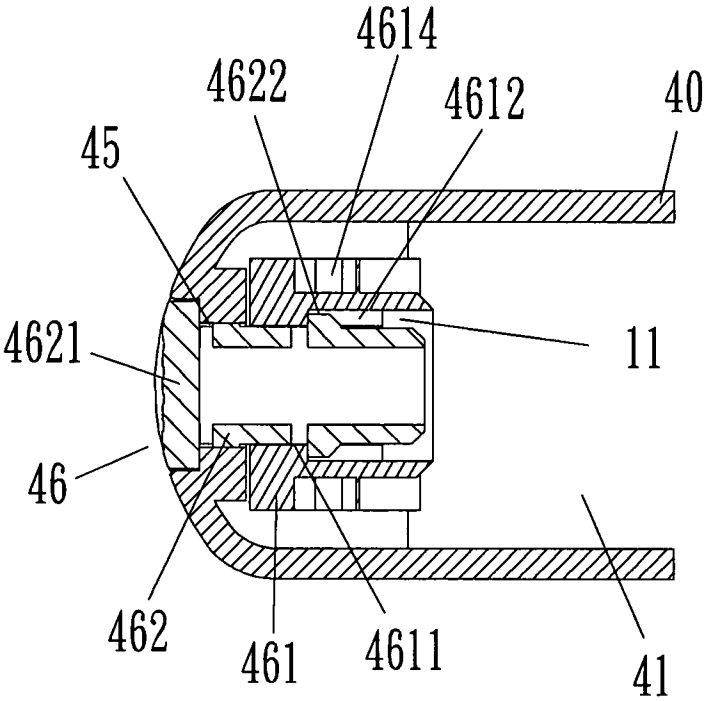
FIG. 8 is a cross-section view of FIG. 7 along an A-A line.
Figure 9:
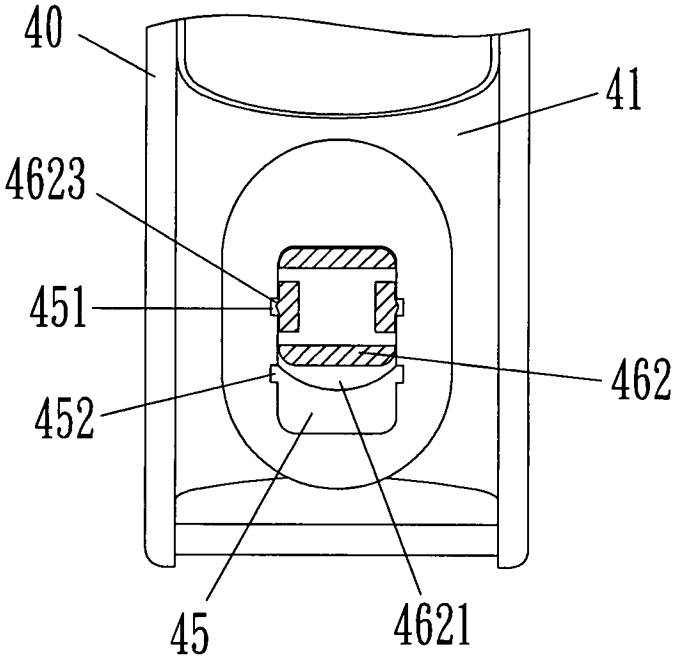
FIG. 9 is a rear view showing the press handle of the preferable embodiment of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 3 to 10, a preferable embodiment of a spray switch for spray gun according to the present invention is illustrated. A main body 10 of the spray gun has a vertical main pipe 11, a nozzle 12 is horizontally connected to the main pipe 11 on a top thereof. A transverse shaft 13 is arranged to the main pipe 11 below the nozzle 12. A platform 14 is formed to a bottom of the nozzle 12 in front of the transverse shaft 13. A side pipe 111 extends from a middle of the main pipe 11. A sliding shaft 15 is sealed slid into the side pipe 111. A valve shaft 16 is arranged inside the main pipe 11 below the side pipe 111. Around a peripheral of a bottom end of the main pipe 10, symmetric lateral slots 112 and rear slots 113 are formed. The main pipe 11 is surrounded by a handle 17. The handle 17 has an open on the side of the side pipe 111. A compress spring 20 is slid around the side pipe 111, one end of the compress spring 20 is pushed against a junction of the main pipe 11 and the side pipe 111 and another end thereof is pushed against a flange 151 formed to an end of the sliding shaft 15.

An approximate square elastic wire 30 is buckled into the rear slots 113 with a middle, section of the elastic wire 30. Two parallel lateral sections 31 extending from the middle section of the elastic wire 30 are buckled into the lateral slots 112. The two end of the elastic wire 30 are bent towards each other so as to form as two symmetric guide pins 32.

A hollow press handle 40 has a receiving chamber 41 inside the handle 40. Two symmetric holes 42 are formed to an upper end of the press handle 40 for being pivoted to the vertical shaft 13 of the main body 10. An open side of the press handle 40 is faced to the handle 17, and a part of the press handle 40 can be received into the open side of the handle 17. The flange 151 is push against an inner wall of the press handle 40. By the compress spring 20, the sliding shaft 15 pushes the press handle 40 so that a top of the press handle 40 will be stopped by the platform 14 below the nozzle 12.

While water comes into the main pipe 11, the valve shaft 16 inside the main pipe 11 will be pushed upwards by the water flow so that an upper end of the valve shaft 16 will seal an inlet of the main pipe 11. In the mean time, the upper end of the valve shaft 16 will touch an end of the sliding shaft 15 of the side pipe 111. While the press handle 40 is pushed towards the handle 17, the sliding shaft 15 is slid along the side pipe 111 and the valve shaft 16 will be pushed away from the inlet so that water will flow into the main pipe 11.

The description above is about the spray gun. The spray switch 46 according to the present invention has a guide block 461 and a buckle unit 462. An open slot 45 is formed to a lower end of the receiving chamber 41 of the press handle 40. The spray switch 46 is arranged to the open 45 and can be switched up and down in the open slot 45.

The guide block 461 has a sliding hole 4611 for receiving the buckle unit 462. A stopper 4612 is formed to two inner lateral walls of the sliding hole 46 respectively. A guide 4613 is formed to two lateral sides of the guide block 461 respectively for guiding the guide pin 32. A recess 4614 is formed near an end of the guide 4613 for temporary holding the guide pin 32.

The buckle unit 462 is arranged to the open slot 45 and can be switched up and down through the open slot 45. An end of the buckle unit 462 is enlarged as an enlarged portion 4621, and the width of the enlarged portion 4621 is wider than the width of the open slot 45 so that the buckle unit 462 can be arranged to the open slot 45 without falling into the receiving chamber 41. An elastic protrusion 4622 is formed to two lateral sides of the buckle unit 462 respectively.

The buckle unit 462 passing through the open slot 45 is inserted into the guide block 461 inside the receiving chamber 41. By the elastic protrusions 4622 being buckled to the stoppers 4612 inside the sliding hole 4611, the spray switch 46 is arranged to the open slot 45 and can be switched up and down along the open slot 45.

Figure 12:
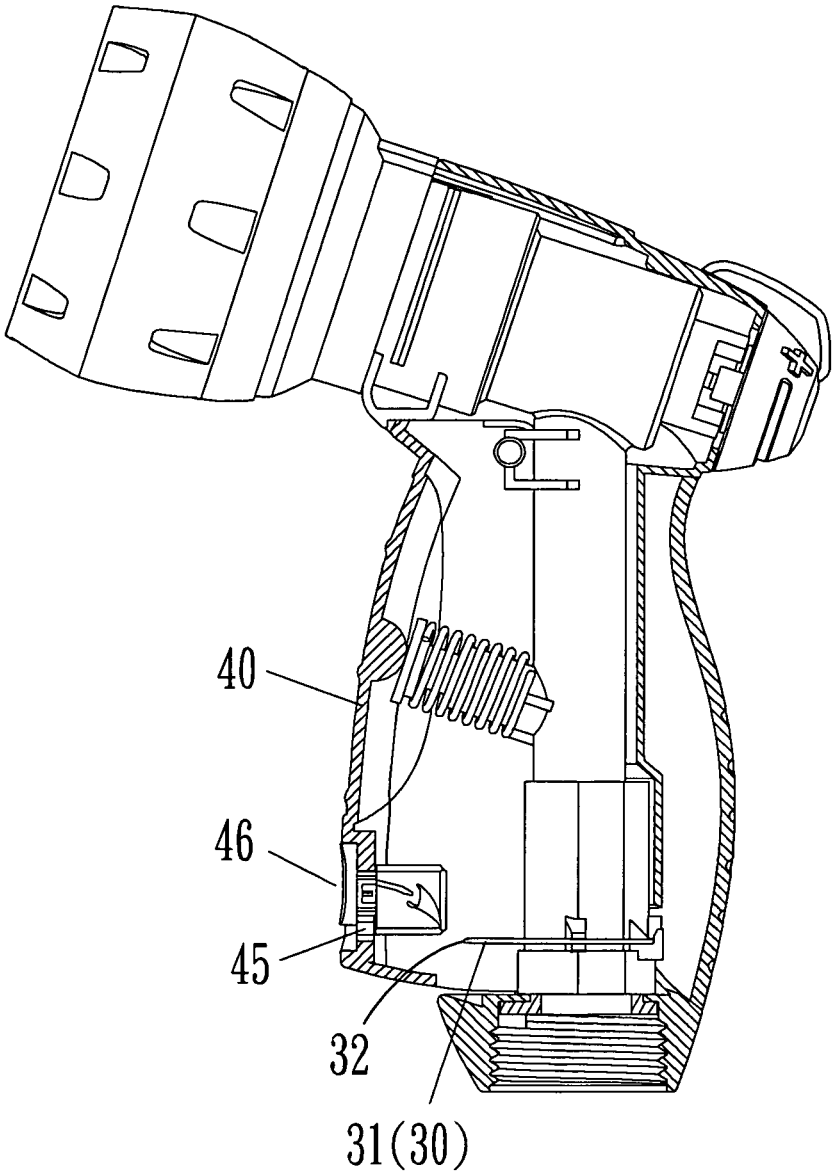
FIG. 12 is a perspective view (2) showing the assembly of the present invention.
Figure 13:
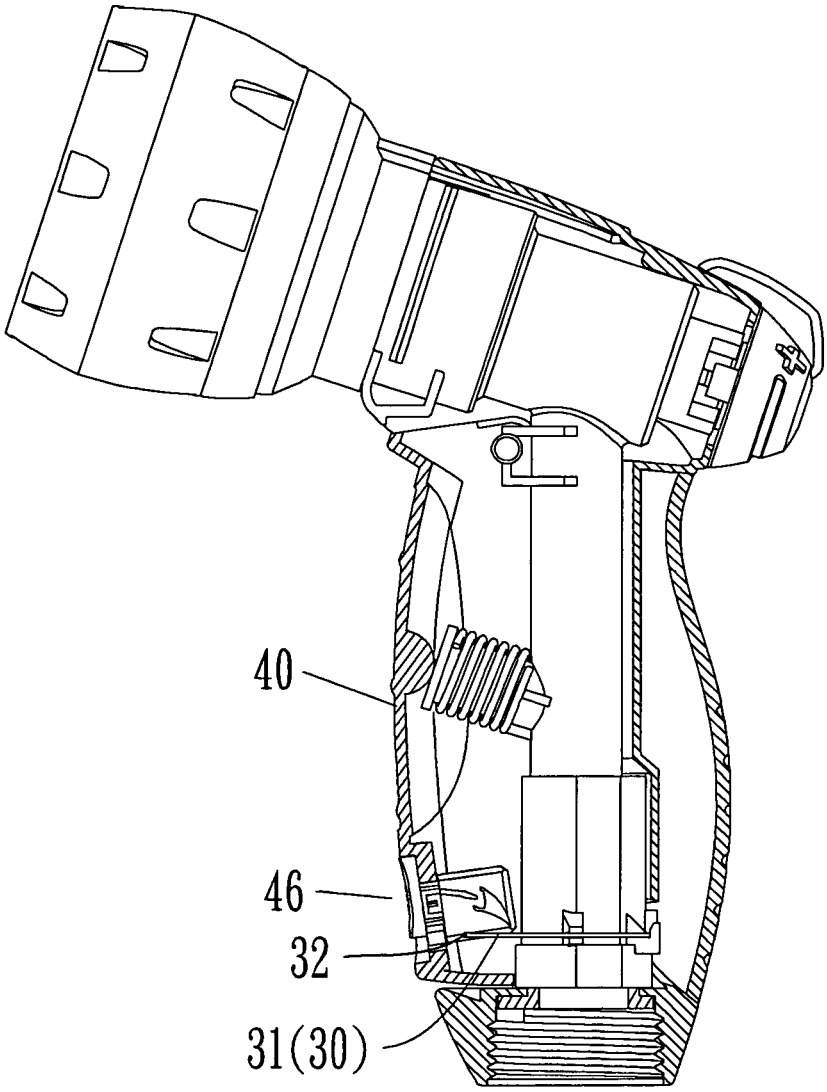
FIG. 13 is a schematic view showing the operation of FIG. 12.

Therefore, the guide pins 32 will not contact the guide block 461 while the spray switch 46 are switched to an up position along the open slot 45. The spray gun can be operated by holding or releasing the press handle 40 to spray or not to spray as shown in FIGS. 12 and 13.

Figure 10:
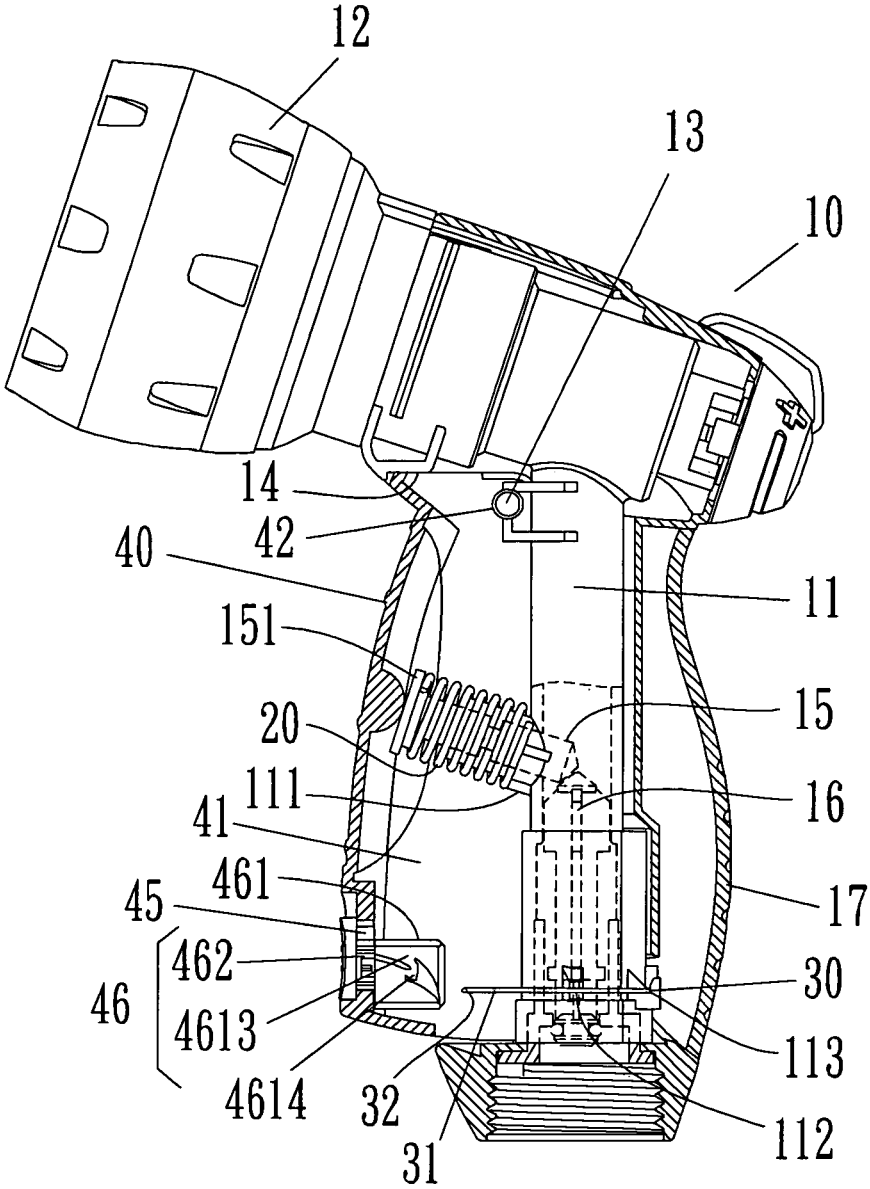
FIG. 10 is a perspective view (1) showing the assembly of the present invention.
Figure 11:
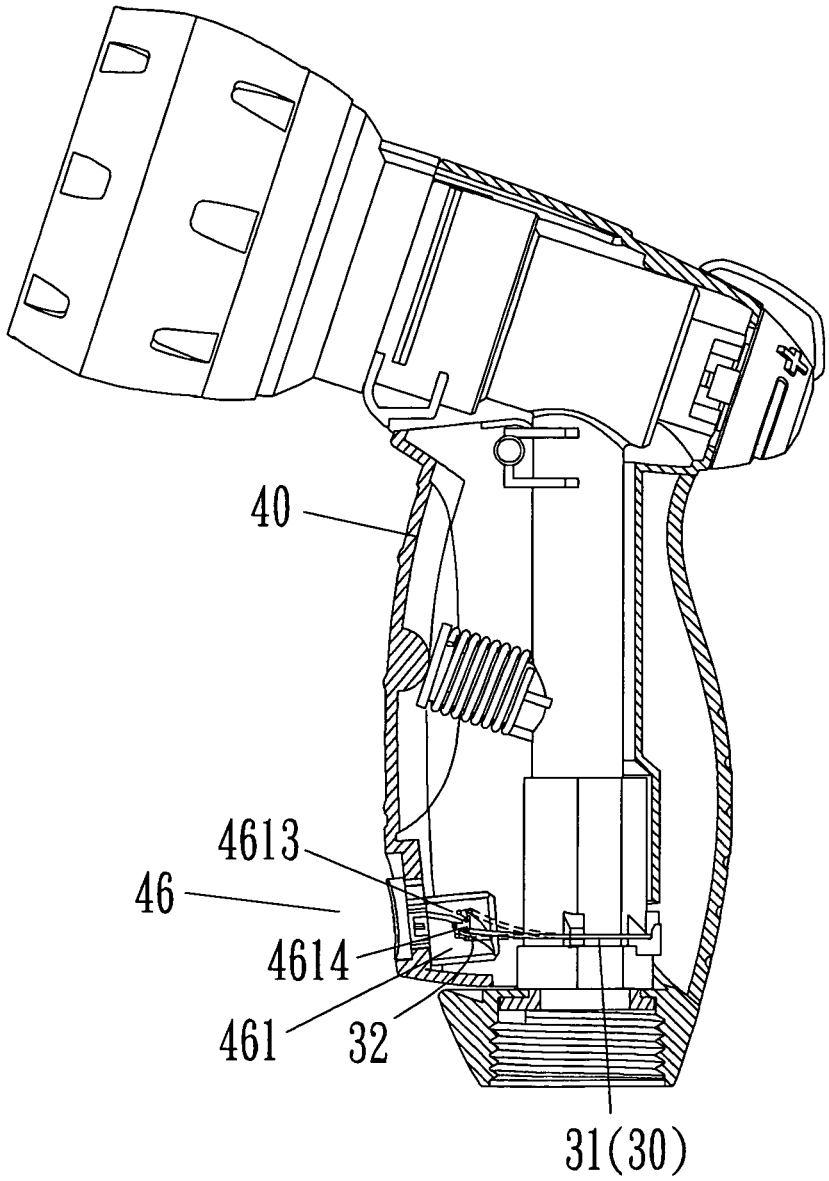
FIG. 11 is a schematic view showing an operation of the present invention.

Referring to FIGS. 10 and 11, the spray switch 46 is switched to a down position along the open slot 45. The guide pins 32 will be bent upwards and slid along an upper rim of the recesses 4614 and an upper rim of the guides 4613 while the press handle 40 is firstly pressed, the guide pins 32 will be held into the recesses 4614 while the press handle 40 is released so that the press handle 40 will remain pressed and the spray gun will continuously spray water. After the second press and release the press handle 40, the guide pins 32 will leave the recesses 4614 and the press handle 40 is back to the origin position.

Therefore, the above assembly is capable of switching between two spray modes of manually controlling the press handle for spraying or continuous spraying by a single press depending on the needs.

Moreover, to ensure the spray switch 46 is actually switched to the up and the down positions, symmetric upper cuts 451 and symmetric lower cuts 452 are formed to the open slot 45. The buckle unit 462 has symmetric protrusions 4623 on two lateral sides for engaging the cuts 451 and 452 while the spray switch 46 is switched.

Figure 14:
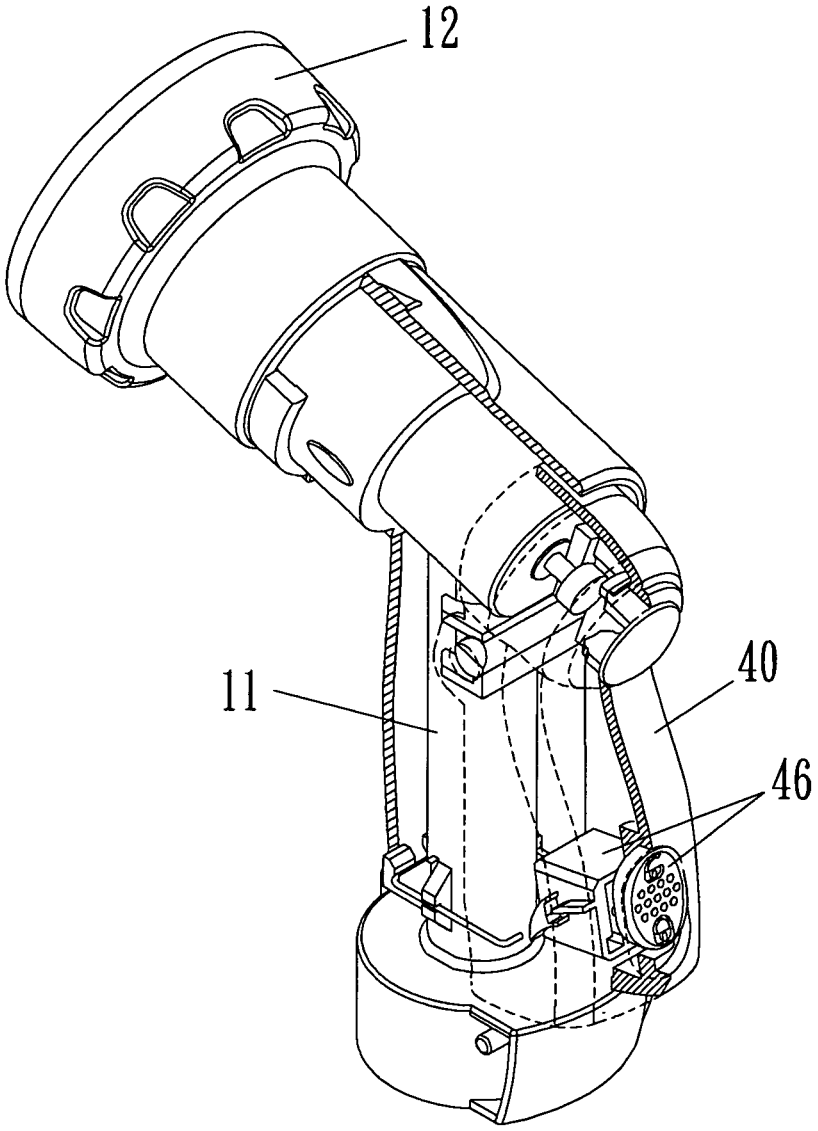
FIG. 14 is a perspective view showing another embodiment of the present invention.

The above preferable embodiment has the press handle 40 pivoted to the same side of the nozzle. However, it is not the only embodiment of the present invention. Referring to FIG. 14, the press handle 40 with the spray switch 46 can be also pivoted to a relative rear side of the nozzle 12.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A spray switch for spray gun, comprising:

a press handle for controlling water spray;

a spray switch being arranged to the press handle for switching a spray mode;

wherein the spray switch arranged to the press handle of the spray gun is switched for changing spray modes between manually controlling the press handle for spraying or continuous spraying by a single press, wherein an elastic wire having symmetric guide pins on two ends thereof is clamped to a main pipe of the spray gun; the spray switch has a guide block having symmetric guide on two lateral sides thereof for guiding the guide pins; symmetric recesses are formed next to the guides respectively for temporary holding the guide pins; by switching the spray switch, the guide block will also be switched to engage or not to engage the guide pins.

2. The spray switch for spray gun as claimed in claim 1, wherein a guide block of the spray switch has a sliding hole having symmetric stoppers on two inner lateral sides; the spray switch has a buckle unit arranged to an open slot of the press handle and for being switched up and down in the open slot; an end of the buckle unit has an enlarged portion so as to keep the buckle unit from falling out of the open slot; another end of the buckle unit is received into the sliding hole; two elastic protrusion is formed to two lateral sides of the buckle unit respectively for buckling the symmetric stoppers.

3. A spray switch for spray gun comprising:

an elastic wire buckled to a main pipe of the spray gun; the elastic wire having two parallel lateral sections; two ends of the lateral sections having two symmetric guide pins;

a press handle pivoted to the main pipe for controlling water spray;

wherein the press handle has an open slot for receiving a spray switch; switching the spray switch for changing spray modes between manually controlling the press handle for spraying or continuous spraying by a single press.

4. The spray switch for spray gun as claimed in claim 3, wherein the spray switch includes a guide block; the guide block has a sliding hole having symmetric stoppers on two inner lateral sides; the guide block has symmetric guides on two outer lateral sides for guiding the guide pins; two symmetric recesses are formed next to the guides respectively for temporary holding the guide pins; a buckle unit is arranged to the open slot for being switched up and down in the open slot; an end of the buckle unit has an enlarged portion so as to keep the buckle unit from falling into the open slot; another end of the buckle unit is received into the sliding hole; two elastic protrusion is formed to two lateral sides of the buckle unit respectively for buckling the symmetric stoppers.

5. The spray switch for spray gun as claimed in claim 3, wherein symmetric upper cuts and symmetric lower cuts are formed to an inner wall of the open slot; the spray switch has a guide block and a buckle unit; the buckle unit has symmetric protrusions on two lateral sides for engaging the cuts while the spray switch is switched.

* * * * *